US011339802B1

(12) United States Patent
Fan

(10) Patent No.: US 11,339,802 B1
(45) Date of Patent: May 24, 2022

(54) CEILING FAN REMOTE CONTROL DEVICE

(71) Applicant: Wei Huang Fan, Taichung (TW)

(72) Inventor: Wei Huang Fan, Taichung (TW)

( * ) Notice: Subject to any disclaimer, the term of this patent is extended or adjusted under 35 U.S.C. 154(b) by 85 days.

(21) Appl. No.: 17/083,347

(22) Filed: Oct. 29, 2020

(51) Int. Cl.
*F04D 29/00* (2006.01)
*F04D 29/60* (2006.01)
*F04D 25/08* (2006.01)

(52) U.S. Cl.
CPC ..... *F04D 29/601* (2013.01); *F04D 25/088* (2013.01); *F04D 29/005* (2013.01)

(58) Field of Classification Search
CPC .... F04D 25/008; F04D 29/601; F04D 29/005; F16D 29/64
USPC ..... 248/343; 416/244 R, 5, 246; 439/537, 439/576; 318/16
See application file for complete search history.

(56) References Cited

U.S. PATENT DOCUMENTS

| | | | | |
|---|---|---|---|---|
| 10,469,001 | B1 * | 11/2019 | Liao | F04D 27/004 |
| 2002/0085919 | A1 * | 7/2002 | Ross | F04D 25/088 416/246 |
| 2019/0264700 | A1 * | 8/2019 | Huggins | F04D 27/002 |
| 2020/0365351 | A1 * | 11/2020 | Dimberg | H01H 23/205 |
| 2021/0215163 | A1 * | 7/2021 | Kang | G05B 15/02 |

* cited by examiner

*Primary Examiner* — Todd M Epps
(74) *Attorney, Agent, or Firm* — Bacon & Thomas, PLLC

(57) ABSTRACT

A ceiling fan remote control device includes a bracket, a remote control, at least one fixation element, and an engaging element. The bracket has at least one mounting hole, an engaging hole, and at least one positioning rod. The at least one mounting hole and the engaging hole are both disposed through the bracket. The at least one positioning rod protrudes from the bracket. The remote control has a receiving groove, a through hole, and at least one positioning groove. The receiving groove and the at least one positioning groove are both formed on the remote control. The through hole is disposed through the remote control. The at least one fixation element passes through the at least one mounting hole. The engaging element passes through the through hole and the engaging hole. The at least one positioning rod of the bracket extends into the at least one positioning groove.

18 Claims, 10 Drawing Sheets

CEILING FAN REMOTE CONTROL DEVICE

BACKGROUND OF THE INVENTION

1. Field of the Invention

The present invention relates to a remote control, and more particularly to a ceiling fan remote control device that can prevent a remote control thereof from being carelessly taken away.

2. Description of Related Art

A conventional remote control for an electrical apparatus such as a ceiling fan can be used to operate the electrical apparatus from a short distance. Working wirelessly, the conventional remote control is portable for users to carry around. Although the conventional remote control is convenient in allowing the users to carry and operate the electrical apparatus in certain areas, the conventional remote control for the electrical apparatus installed in public spaces such as a classroom, a train station, a hotel room, a hotel lobby, or a restaurant may be carelessly taken away by students, travelers or customers. Therefore, the loss of the conventional remote control for the electrical apparatus installed in public spaces occurs from time to time.

To overcome the shortcomings of the conventional remote control, the present invention tends to provide a ceiling fan remote control device to mitigate or obviate the aforementioned problems.

SUMMARY OF THE INVENTION

The main objective of the present invention is to provide a ceiling fan remote control device.

The ceiling fan remote control device in accordance with the present invention includes a bracket, a remote control, at least one fixation element, and an engaging element. The bracket has at least one mounting hole, an engaging hole, and at least one positioning rod. The at least one mounting hole is disposed through the bracket. The engaging hole is disposed through the bracket and is spaced apart from the at least one mounting hole. The at least one positioning rod protrudes from the bracket. The remote control is fixed onto the bracket and has a receiving groove, a through hole, and at least one positioning groove. The receiving groove is formed on one of two surfaces of the remote control away from the bracket. The through hole is disposed through the remote control and communicates with the engaging hole of the bracket. The at least one positioning groove is formed on the other one of the two surfaces of the remote control adjacent to the bracket. The at least one fixation element passes through the at least one mounting hole of the bracket to fix the bracket onto a fixture. The engaging element passes through the through hole of the remote control and the engaging hole of the bracket and engages with the engaging hole to fix the remote control onto the bracket. The at least one positioning rod of the bracket extends into the at least one positioning groove of the remote control to position the remote control.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
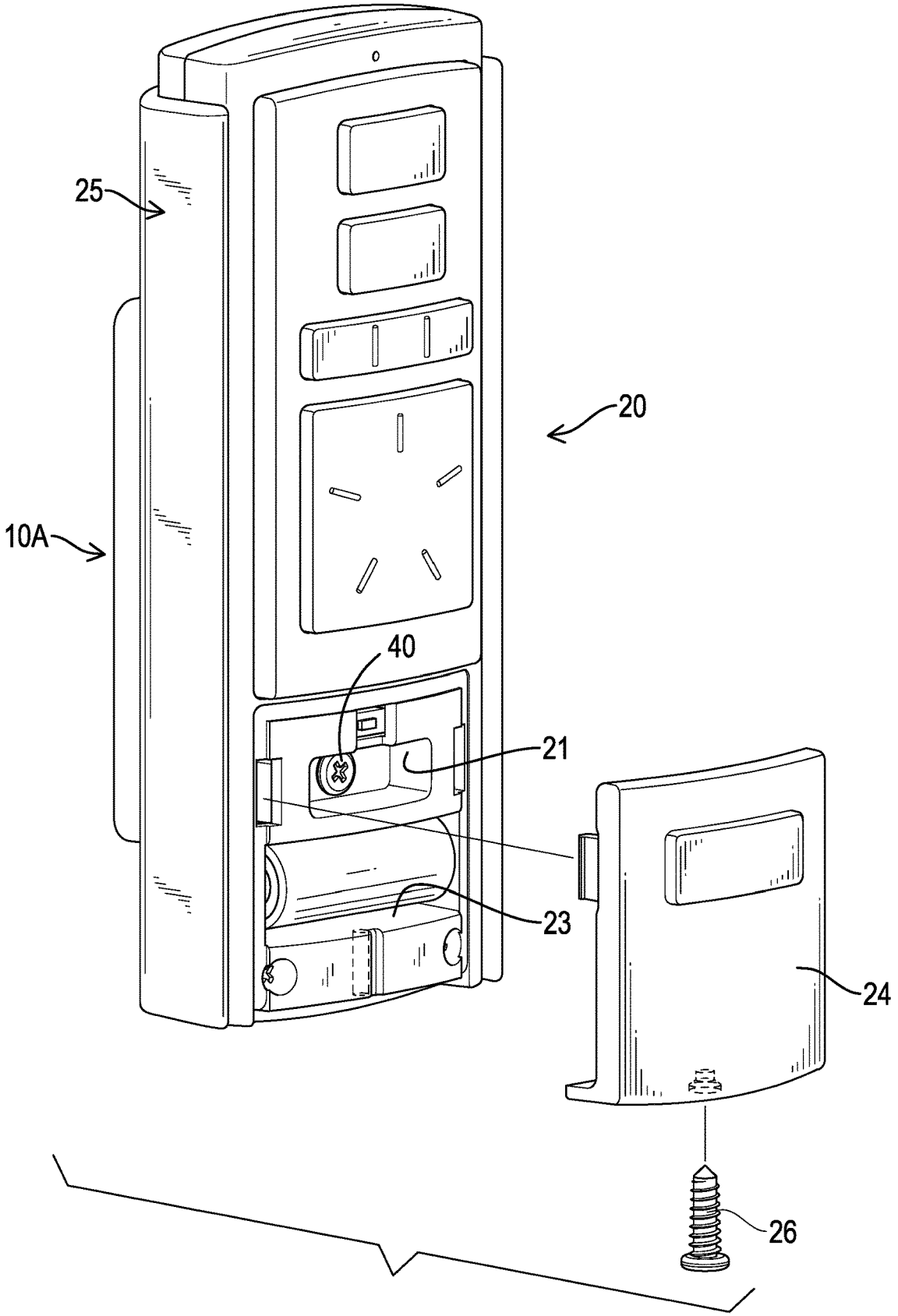
FIG. 1 is an exploded perspective view of a first embodiment of a ceiling fan remote control device in accordance with the present invention.
Figure 2:
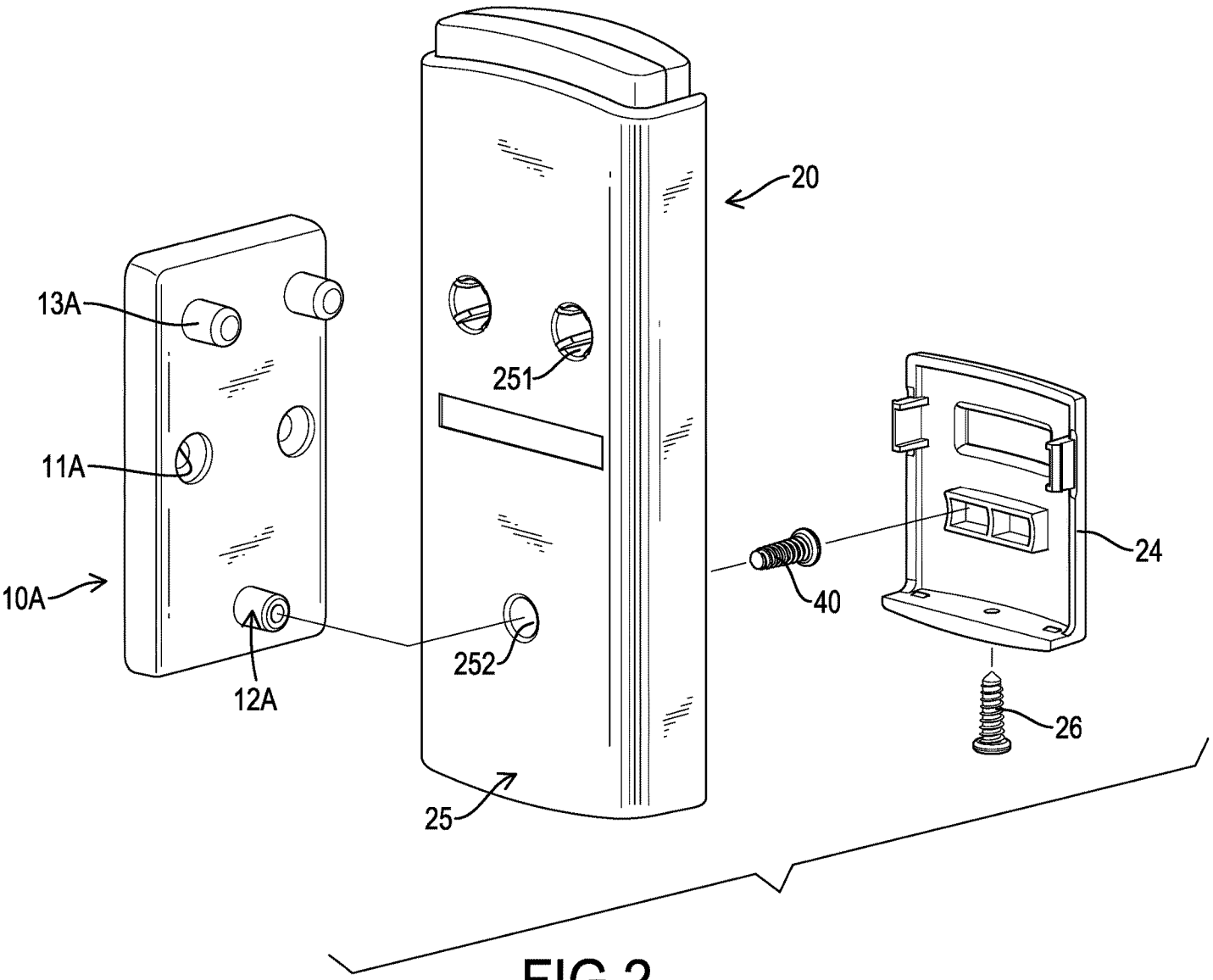
FIG. 2 is a further exploded perspective view of the ceiling fan remote control device in FIG. 1.
Figure 3:
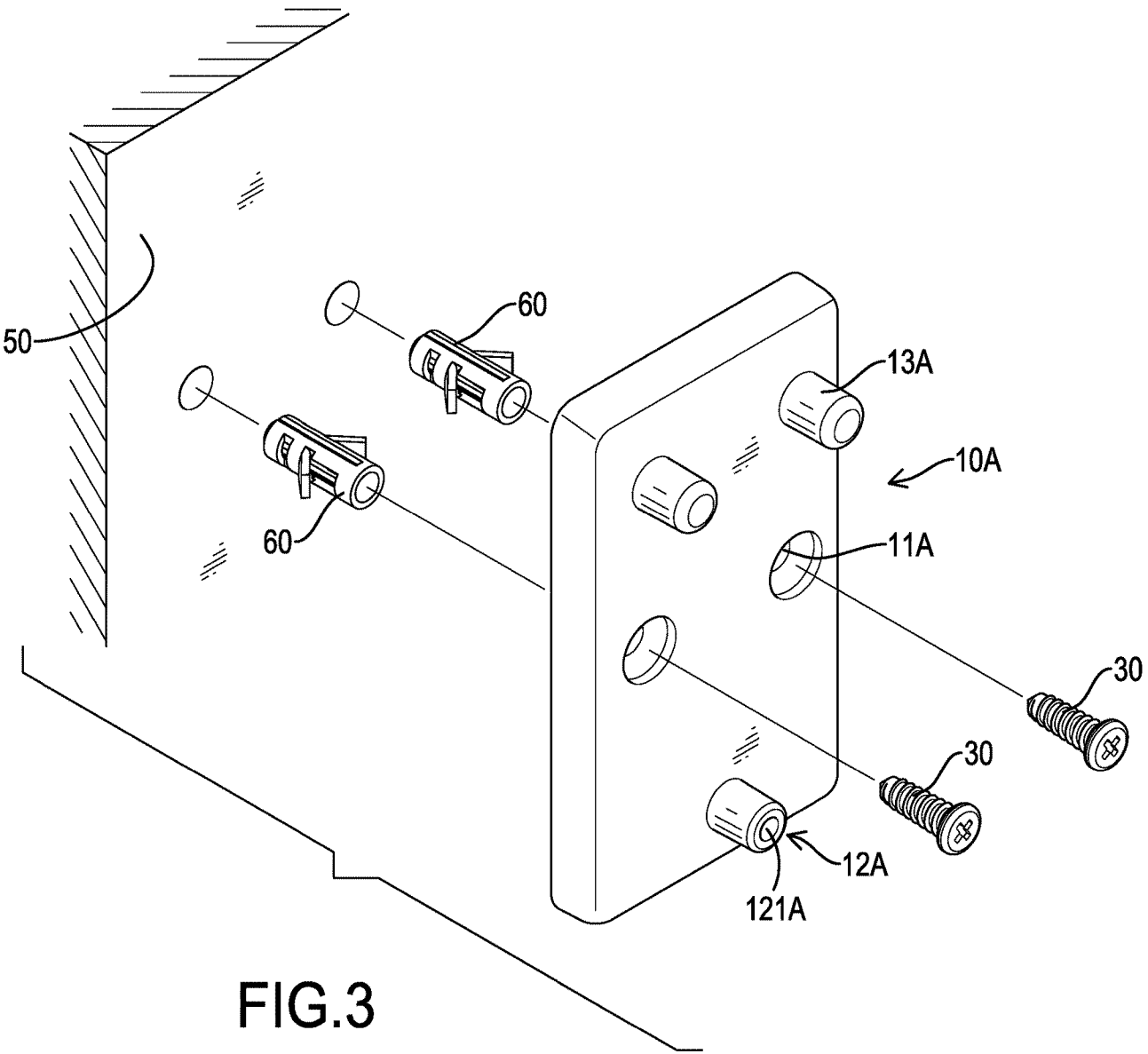
FIG. 3 is an exploded perspective view of an on-wall bracket and fixation elements of the ceiling fan remote control device in FIG. 1, shown with the on-wall bracket detached from a wall.

With reference to FIGS. 1 to 3, a first embodiment of a ceiling fan remote control device in accordance with the present invention includes an on-wall bracket 10A, a remote control 20, two fixation elements 30, and an engaging element 40.

Figure 5:
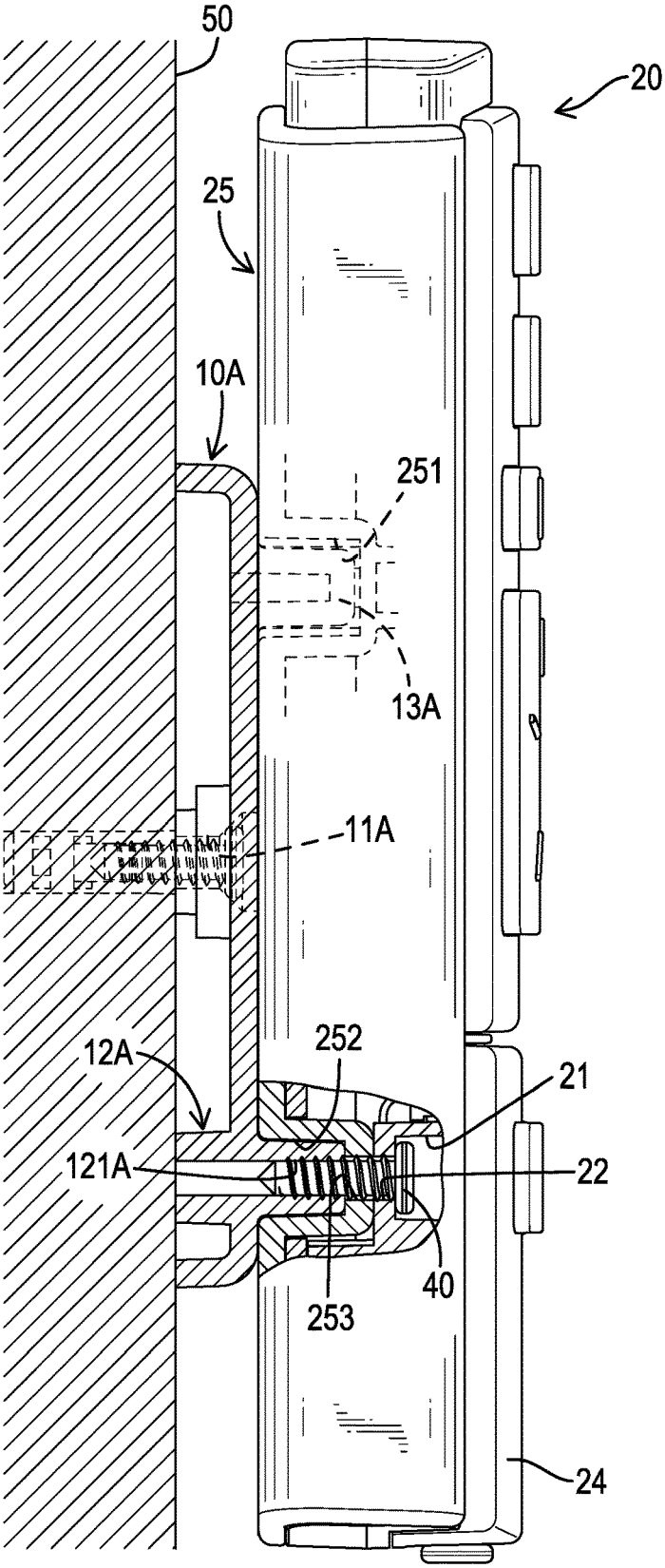
FIG. 5 is an operational side view in partial section of the ceiling fan remote control device along line 5-5 in FIG. 4.

With reference to FIGS. 2 and 3, the on-wall bracket 10A is fixed onto a fixture and has two mounting holes 11A, an engaging rod 12A, and two positioning rods 13A. The two mounting holes 11A are disposed through the on-wall bracket 10A and are spaced apart from each other. The engaging rod 12A protrudes from one of two surfaces of the on-wall bracket 10A opposite to the fixture, is below the two mounting holes 11A, and has an engaging hole 121A. With reference to FIGS. 3 and 5, the engaging hole 121A is formed in the engaging rod 12A, is disposed through the on-wall bracket 10A, and is spaced apart from each one of the two mounting holes 11A. The two positioning rods 13A protrude from one of the two surfaces of the on-wall bracket 10A in the same position where the engaging rod 12A protrudes from, are spaced apart from each other, and are above the two mounting holes 11A. In addition, in the first embodiment of the ceiling fan remote control device in accordance with the present invention, the on-wall bracket 10A is fixed onto the fixture, which is a wall 50.

With reference to FIGS. 1, 2, and 5, the remote control 20 is fixed onto the on-wall bracket 10A and has a receiving groove 21, a compartment hole 22, a battery chamber 23, a battery cover 24, and a cover shell 25. The receiving groove 21 is formed on one of two surfaces of the remote control 20 away from the on-wall bracket 10A. The compartment hole 22 is disposed in the receiving groove 21, is disposed through the receiving groove 21, and is aligned with the engaging hole 121A of the engaging rod 12A. The battery chamber 23 is formed on one of the two surfaces of the remote control 20 away from the on-wall bracket 10A and is below the receiving groove 21. The battery cover 24 is mounted on one of the two surfaces of the remote control 20 away from the on-wall bracket 10A via a self-tapping screw 26 and covers the receiving groove 21 and the battery chamber 23.

The cover shell 25 partially covers the remote control 20 and has two positioning grooves 251 and a retaining groove 252. The two positioning grooves 251 are formed on an outer surface of the cover shell 25 facing the on-wall bracket 10A, and each one of the two positioning grooves 251 corresponds to a respective one of the two positioning rods 13A of the on-wall bracket 10A in contour and position. The retaining groove 252 is formed on the outer surface of the cover shell 25 facing the on-wall bracket 10A, corresponds to the engaging rod 12A of the on-wall bracket 10A in contour and position, and has a receiving hole 253. The receiving hole 253 is disposed through the retaining groove 252 and communicates with the compartment hole 22. The receiving hole 253 and the compartment hole 22 form a through hole disposed in the receiving groove 21, disposed through the remote control 20, and aligned with the engaging hole 121A of the engaging rod 12A.

Figure 6:
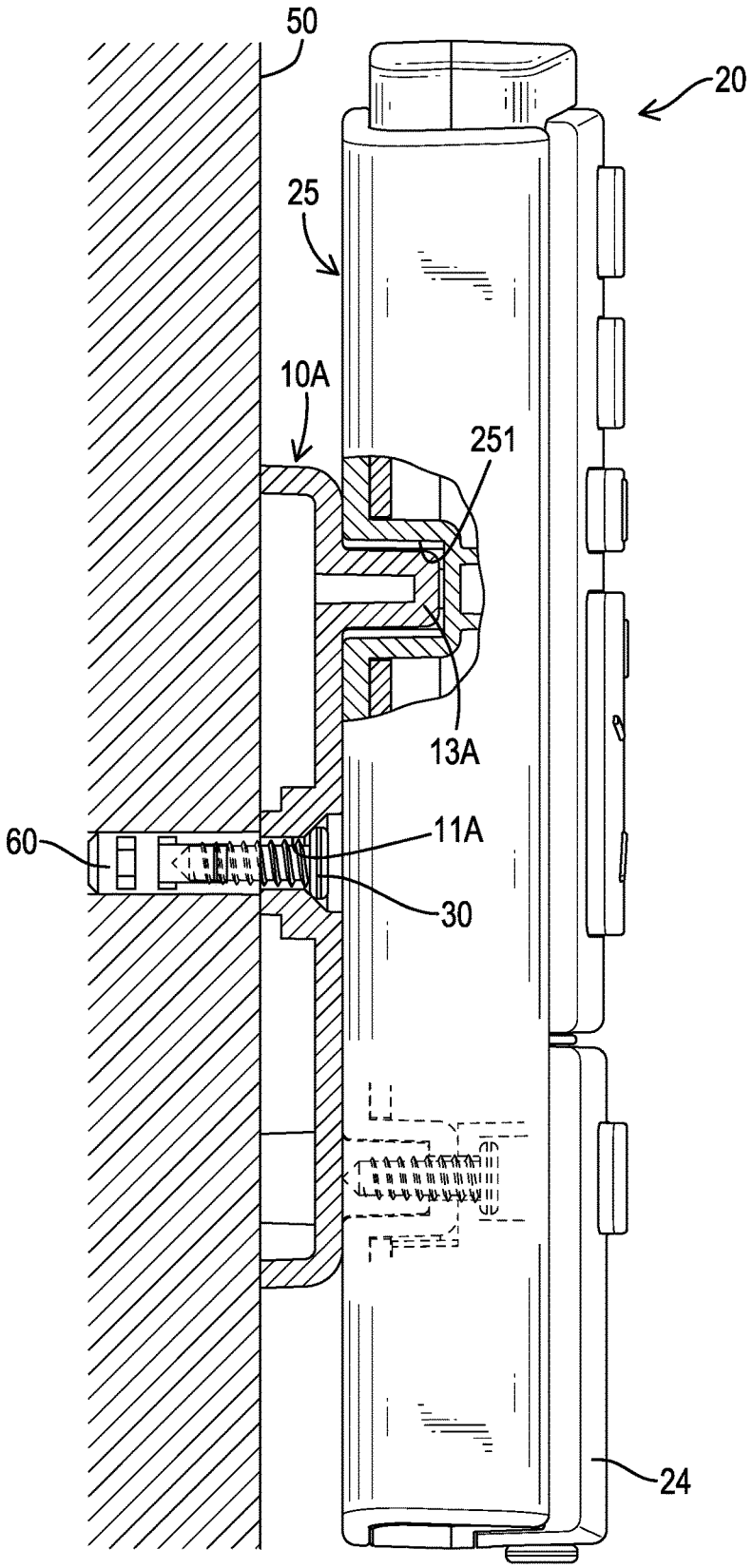
FIG. 6 is an operational side view in partial section of the ceiling fan remote control device along line 6-6 in FIG. 4.
Figure 7:
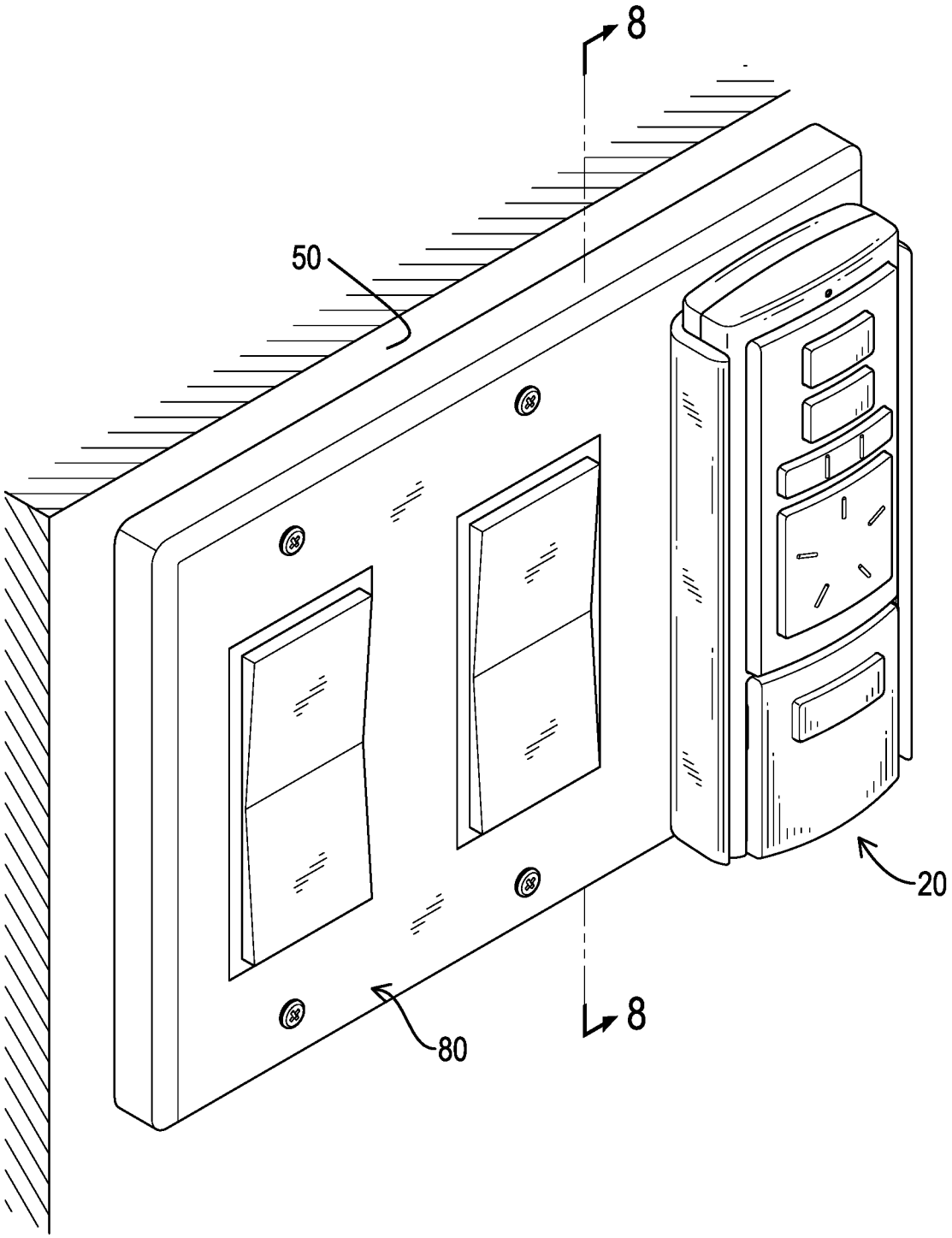
FIG. 7 is an operational perspective view of a second embodiment of a ceiling fan remote control device in accordance with the present invention.

With reference to FIGS. 5 and 6, when the remote control 20 is mounted to the on-wall bracket 10A, the two positioning rods 13A of the on-wall bracket 10A respectively extend into the two positioning grooves 251 of the cover shell 25 to position the remote control 20, the engaging rod 12A of the on-wall bracket 10A extends into the retaining groove 252 of the cover shell 25, the outer surface of the cover shell 25 abuts against one of the two surfaces of the on-wall bracket 10A facing the remote control 20, and the through hole of the remote control 20 communicates with the engaging hole 121A of the on-wall bracket 10A. When the engaging rod 12A of the on-wall bracket 10A extends into the retaining groove 252 of the cover shell 25, the through hole of the remote control 20 communicates with the engaging hole 121A of the engaging rod 12A.

Figure 4:
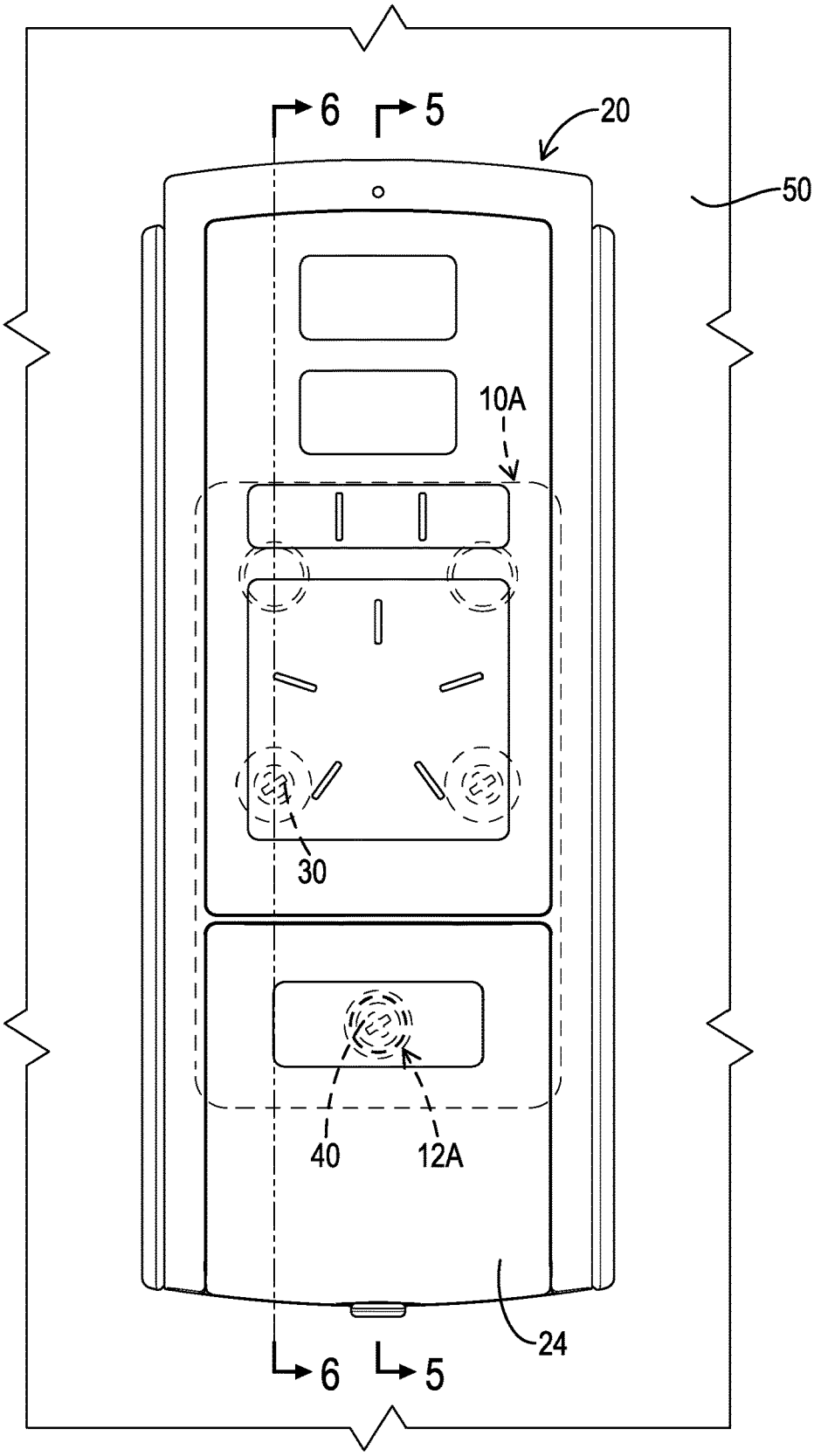
FIG. 4 is an operational front side view of the ceiling fan remote control device in FIG. 1.

With reference to FIGS. 3, 4, and 6, the two fixation elements 30 respectively pass through the two mounting holes 11A of the on-wall bracket 10A to fix the on-wall bracket 10A onto the fixture. In the first embodiment of the ceiling fan remote control device in accordance with the present invention, each one of the two fixation elements 30 is a wood screw.

With reference to FIGS. 1, 2, 4, and 5, the engaging element 40 passes through the through hole of the remote control 20 and the engaging hole 121A of the engaging rod 12A and engages with the engaging hole 121A to fix the remote control 20 onto the on-wall bracket 10A. In the present invention, the engaging element 40 is a self-tapping screw.

With reference to FIGS. 3 to 6, to mount the first embodiment of the ceiling fan remote control device in accordance with the present invention onto the wall 50, tap two wall anchors 60 into the wall 50 firstly. Then press the on-wall bracket 10A against the wall 50 and make the two mounting holes 1/ A of the on-wall bracket 10A align with the two wall anchors 60 respectively. Next, insert each one of the two fixation elements into a respective one of the two mounting holes 11A of the on-wall bracket 10A and one of the two wall anchors 60 aligned with the said mounting hole 11A to fix the on-wall bracket 10A onto the wall 50. To fix the remote control 20 onto the on-wall bracket 10A, mount the remote control 20 onto the on-wall bracket 10A firstly by making the two positioning rods 13A respectively extend into the two positioning grooves 251 of the cover shell 25 and making the engaging rod 12A extend into the retaining groove 252 of the cover shell 25. Next, insert the engaging element 40 through the through hole of the remote control 20 and the engaging hole 121A of the on-wall bracket 10A and make the engaging element 40 engage with the engaging hole 121A to fix the remote control 20 onto the on-wall bracket 10A. Lastly, mount the battery cover 24 on the remote control 20 to cover the receiving groove 21 and the battery chamber 23.

With reference to FIG. 4, if an owner of the ceiling fan remote control device in accordance with the present invention wants to detach the remote control 20 from the on-wall bracket 10A, the owner can detach the engaging element 40 from the remote control 20 and the on-wall bracket 10A and take the remote control 20. Then mount the battery cover 24 on the remote control 20 to cover the receiving groove 21 and the battery chamber 23.

Figure 8:
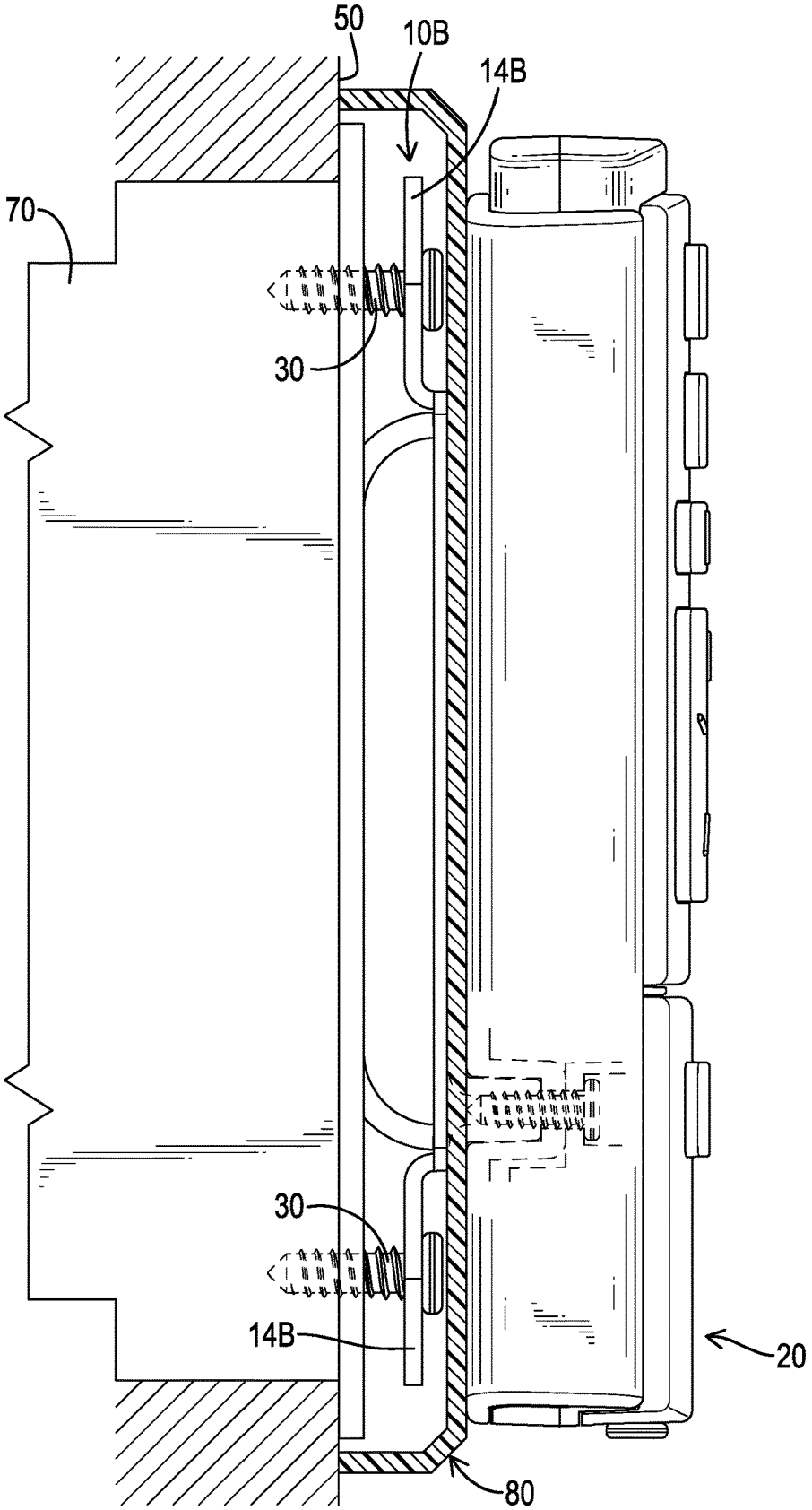
FIG. 8 is an operational side view in partial section of the ceiling fan remote control device along line 8-8 in FIG. 7.
Figure 9:
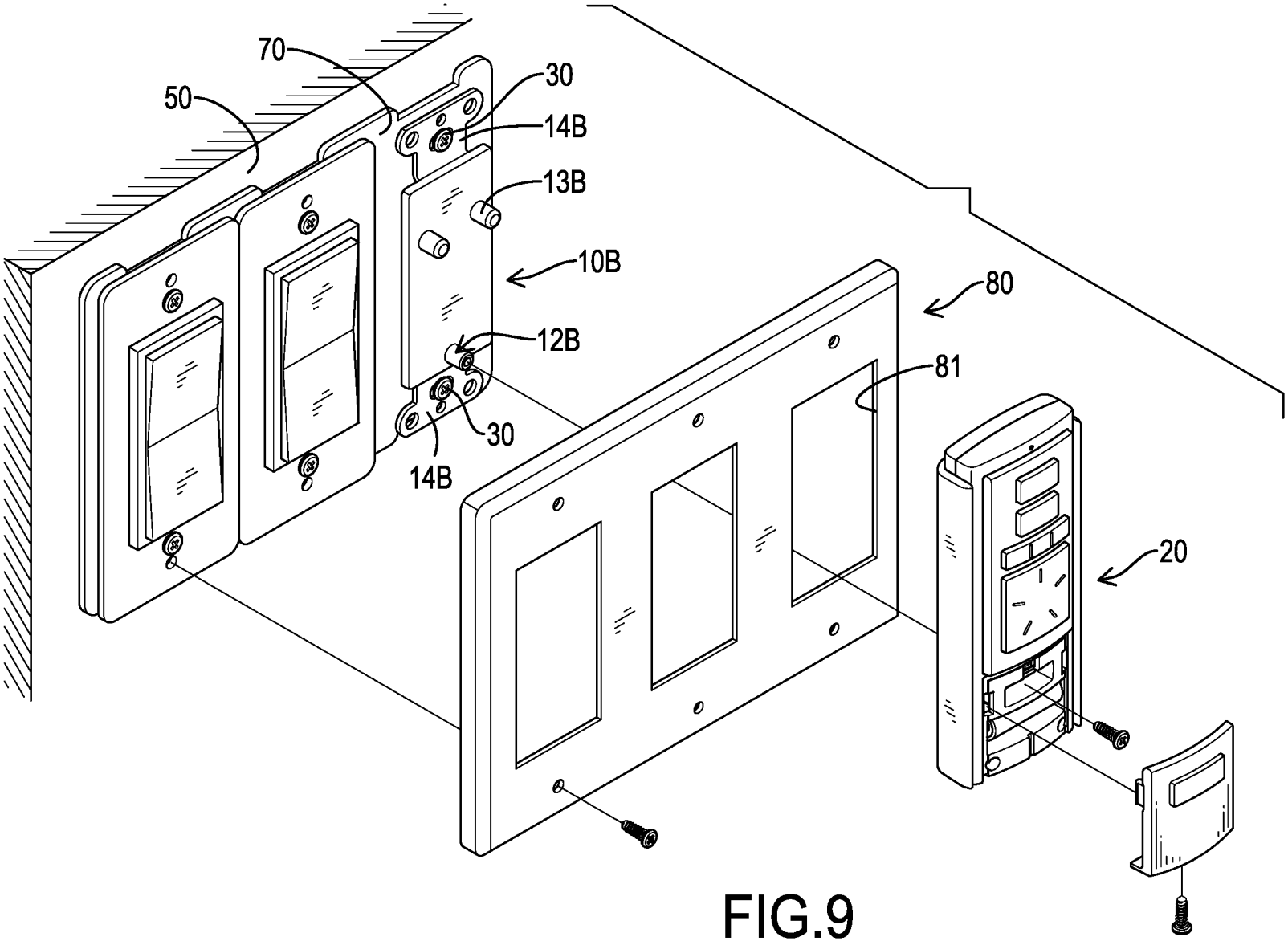
FIG. 9 is an exploded perspective view of the ceiling fan remote control device in FIG. 7.
Figure 10:
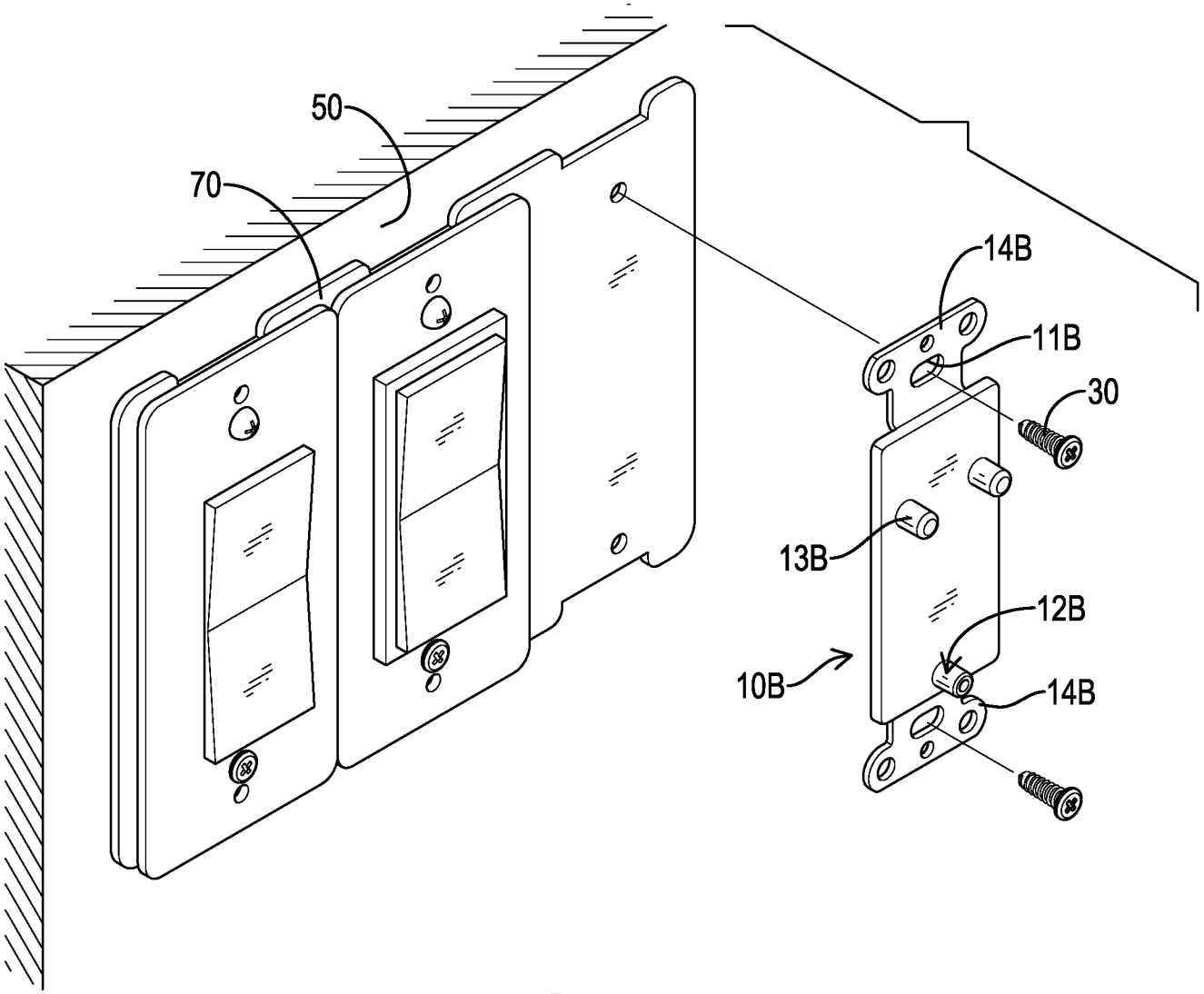
FIG. 10 is an exploded perspective view of a decorative in-wall bracket and fixation elements of the ceiling fan remote control device in FIG. 7.

With reference to FIGS. 7 to 10, a second embodiment of a ceiling fan remote control device in accordance with the present invention is substantially the same as the first embodiment, and the difference between the second embodiment and the first embodiment is that: the ceiling fan remote control device includes a decorative in-wall bracket 10B, and the decorative in-wall bracket 10B is fixed onto a gang box 70. With reference to FIGS. 9 and 10, the decorative in-wall bracket 10B has two connecting plates 14B and two mounting holes 11B. The two connecting plates 14B are respectively disposed at a top end and a bottom end of the decorative in-wall bracket 10B. The two mounting holes 11B are respectively disposed through the two connecting plates 14B. With reference to FIGS. 8 to 10, the two fixation elements 30 respectively pass through the two mounting holes 11B of the decorative in-wall bracket 10B to fix the decorative in-wall bracket 10B onto the gang box 70. In the second embodiment of the ceiling fan remote control device in accordance with the present invention, each one of the two fixation elements 30 may be a machine screw or a wood screw, and the engaging element 40 is a machine screw.

With reference to FIGS. 8 to 10, to mount the second embodiment of the ceiling fan remote control device in accordance with the present invention onto the gang box 70, install the gang box 70 on the wall 50. Then press the decorative in-wall bracket 10B against the gang box 70 and insert each one of the two fixation elements 30 into a respective one of the two mounting holes 11B of the decorative in-wall bracket 10B and the gang box 70 to fix the decorative in-wall bracket 10B onto the gang box 70. Next, mount a wall plate 80 onto the wall 50 to cover the gang box 70 and make the engaging rod 12B and the two positioning rods 13B of the decorative in-wall bracket 10B extend out of a port 81 of the wall plate 80. Finally, fix the remote control 20 onto the decorative in-wall bracket 10B in the same way as how the remote control 20 is fixed onto the on-wall bracket 10A of the first embodiment of the ceiling fan remote control device in accordance with the present invention.

With the aforementioned technical characteristics, the ceiling fan remote control device has the following advantages.

1. Being fixed onto the on-wall bracket 10A or the decorative in-wall bracket 10B, the remote control 20 for electrical apparatus installed in public spaces will not be taken by students, travelers or customers carelessly. Thus the loss of the remote control 20 can be prevented.

2. Since the battery chamber 23 is formed on one of the two surfaces of the remote control 20 away from the on-wall bracket 10A or the decorative in-wall bracket 10B, the owner of the remote control 20 can just detach the battery cover 24 from the remote control 20 and change the battery installed in the battery chamber 23 without having to detach the remote control 20 from the on-wall bracket 10A or the decorative in-wall bracket 10B.

3. If the owner of the remote control 20 wants to take the remote control 20 to other places, the remote control 20 can be detached from the on-wall bracket 10A or the decorative in-wall bracket 10B by detaching the engaging element 40 from the remote control 20 and the on-wall bracket 10A or the decorative in-wall bracket 10B. Therefore, the remote control 20 of the ceiling fan remote control device in accordance with the present invention can also be used in a portable way if needed.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ceiling fan remote control device comprising:
- a bracket having
  - at least one mounting hole disposed through the bracket;
  - an engaging hole disposed through the bracket and being spaced apart from the at least one mounting hole; and
  - at least one positioning rod protruding from the bracket;
- a remote control fixed onto the bracket and having
  - a receiving groove formed on one of two surfaces of the remote control away from the bracket;
  - a through hole disposed through the remote control and communicating with the engaging hole of the bracket; and
  - at least one positioning groove formed on the other one of the two surfaces of the remote control adjacent to the bracket;
- at least one fixation element passing through the at least one mounting hole of the bracket to fix the bracket onto a fixture; and
- an engaging element passing through the through hole of the remote control and the engaging hole of the bracket and engaging with the engaging hole to fix the remote control onto the bracket;
- wherein the at least one positioning rod of the bracket extends into the at least one positioning groove of the remote control to position the remote control.

2. The ceiling fan remote control device as claimed in claim 1, wherein the through hole of the bracket is disposed in the receiving groove.

3. The ceiling fan remote control device as claimed in claim 1, wherein the bracket is a decorative in-wall bracket.

4. The ceiling fan remote control device as claimed in claim 3, wherein
- the bracket has
  - two connecting plates disposed at two ends of the bracket; and
  - two said mounting holes respectively disposed through the two connecting plates; and
- the ceiling fan remote control device has two said fixation elements respectively passing through the two said mounting holes of the bracket to fix the bracket onto a gang box.

5. The ceiling fan remote control device as claimed in claim 1, wherein the bracket is an on-wall bracket.

6. The ceiling fan remote control device as claimed in claim 5, wherein the at least one mounting hole of the bracket is disposed between the engaging hole and the at least one positioning rod.

7. The ceiling fan remote control device as claimed in claim 1, wherein the remote control has a battery chamber formed on one of the two surfaces of the remote control away from the bracket.

8. The ceiling fan remote control device as claimed in claim 7, wherein the bracket is an on-wall bracket.

9. The ceiling fan remote control device as claimed in claim 8, wherein the at least one mounting hole of the bracket is disposed between the engaging hole and the at least one positioning rod.

10. The ceiling fan remote control device as claimed in claim 7, wherein the through hole of the bracket is disposed in the receiving groove.

11. The ceiling fan remote control device as claimed in claim 7, wherein the bracket is a decorative in-wall bracket.

12. The ceiling fan remote control device as claimed in claim 11, wherein
- the bracket has
  - two connecting plates disposed at two ends of the bracket; and
  - two said mounting holes respectively disposed through the two connecting plates; and
- the ceiling fan remote control device has two said fixation elements respectively passing through the two said mounting holes of the bracket to fix the bracket onto a gang box.

13. The ceiling fan remote control device as claimed in claim 7, wherein the remote control has a battery cover mounted on one of the two surfaces of the remote control away from the bracket and covering the receiving groove and the battery chamber.

14. The ceiling fan remote control device as claimed in claim 13, wherein the bracket is an on-wall bracket.

15. The ceiling fan remote control device as claimed in claim 14, wherein the at least one mounting hole of the bracket is disposed between the engaging hole and the at least one positioning rod.

16. The ceiling fan remote control device as claimed in claim 13, wherein the bracket is a decorative in-wall bracket.

17. The ceiling fan remote control device as claimed in claim 16, wherein
- the bracket has
  - two connecting plates disposed at two ends of the bracket; and
  - two said mounting holes respectively disposed through the two connecting plates; and
- the ceiling fan remote control device has two said fixation elements respectively passing through the two said mounting holes of the bracket to fix the bracket onto a gang box.

18. The ceiling fan remote control device as claimed in claim 13, wherein the through hole of the bracket is disposed in the receiving groove.

* * * * *